US005531090A

United States Patent [19]

Klein et al.

[11] Patent Number: 5,531,090

[45] Date of Patent: Jul. 2, 1996

[54] ADJUSTING DEVICE FOR THE BRUSH ROLL IN A ROLL STAND

[75] Inventors: Achim Klein, Kreuztal; Hans-Jürgen Bender, Olpe, both of Germany

[73] Assignee: SMS Schloemann-Siemag Aktiengesellschaft, Dusseldorf, Germany

[21] Appl. No.: 173,580

[22] Filed: Dec. 23, 1993

[30] Foreign Application Priority Data

Dec. 30, 1992 [DE] Germany ..... 42 44 524.8

[51] Int. Cl.[6] ..... B21B 28/00

[52] U.S. Cl. ..... 72/236; 72/245

[58] Field of Search ..... 72/245, 236, 237, 72/238, 249

[56] References Cited

U.S. PATENT DOCUMENTS

| | | | |
|---|---|---|---|
| 3,603,125 | 9/1971 | Edwards | 72/236 |
| 4,967,582 | 11/1990 | Bohnenkamp | 72/245 |
| 4,986,178 | 1/1991 | Hafner et al. | 72/236 |

FOREIGN PATENT DOCUMENTS

| | | | |
|---|---|---|---|
| 4105079 | 10/1991 | Germany | 72/236 |
| 0013549 | 6/1968 | Japan | 72/236 |
| 0167008 | 10/1983 | Japan | 72/236 |
| 0104408 | 4/1990 | Japan | 72/236 |

*Primary Examiner*—Lowell A. Larson
*Assistant Examiner*—Thomas C. Schoeffler
*Attorney, Agent, or Firm*—Friedrich Kueffner

[57] ABSTRACT

A device for adjusting a brush roll relative to a work roll in roll stand, particularly a roll stand for hot-rolling of aluminum includes pivotable supports mounted on both sides of the brush roll. The brush roll is rotatable in a direction opposite the direction of rotation of the work roll. The brush roll is displaceable in translatory movements parallel to the work roll. The pivot bearing of each brush roll support is arranged on a work roll chock, wherein the support includes a pivoting lever which is located between a controllable actuating element and a restoring support element. The actuating element is mounted in the balancing block or bending block of the roll stand and the support element is mounted in the chock.

20 Claims, 2 Drawing Sheets

ADJUSTING DEVICE FOR THE BRUSH ROLL IN A ROLL STAND

BACKGROUND OF THE INVENTION

1. Field of the Invention

The present invention relates to a device for adjusting a brush roll relative to a work roll of a roll stand, particularly the work roll of a roll stand for hot-rolling of aluminum. The brush roll is rotatable in a direction opposite the direction of rotation of the work roll. The brush roll is displaceable in translatory movements parallel to the work roll and the brush roll is on both sides thereof supported in pivotable supports.

2. Description of the Related Art

Brush systems on the work rolls of a work stand, for example, for hot-rolling of aluminum, are required for removing any particles which may adhere to the rolls and which would otherwise damage the surface of the rolled material. The brushes rotate in a direction opposite the direction of rotation of the roll and can be moved back and forth by certain distances in translatory movements parallel to the roll axis. When the work rolls do not rotate, the brush rolls must be lifted off from the work rolls in order to avoid drag marks and images on the surface of the roll, on the one hand, and to facilitate the disassembly and exchange of the work rolls, on the other hand.

In a conventional device for adjusting a brush roll, a cassette-type configuration is provided for the brush support. In that case, the chock of the brush roll is surrounded by a C-shaped frame and is displaceably mounted in the C-shaped frame. The displacement is effected by means of the pistons of two hydraulic units which are arranged opposite each other in the cassette frame and whose pistons act on the surfaces of the chock provided for this purpose. In this draw-type guidance or cassette-type configuration, it was necessary to be very careful to ensure that the play in the guidance was kept very small. This was not always possible, particularly because the play increases as the duration of operation increases. The play existing in the guidance caused vibrations which, in turn, resulted in markings on the work roll, particularly if the brush roll included a wire brush.

SUMMARY OF THE INVENTION

Therefore, it is the primary object of the present invention to improve the previously utilized brush adjusting system, particularly in those stands in which the space available for mounting and assembling is extremely narrow.

In addition, it is an object of the present invention to improve the use of brush adjusting systems in roll stands with adjusting systems for rolls with contoured surfaces, such as, continuous variable crown rolls (CVC rolls).

In accordance with the present invention, in an adjusting device for a brush roll of the above-described type, the pivot bearing of each brush roll support is arranged on the chock of the work roll, the support includes a pivoting lever which is located between a controllable actuating element and a restoring support element, wherein the actuating element is arranged in the balancing block or bending block for the work rolls and the support element is arranged on the chock of the work roll.

The pivoting brush support proposed in accordance with the present invention provides the advantage that there no longer takes place any relative movement in the vertical plane of elements between the brush support and the chock.

In addition, there are no relative movements between the support, the actuating element and the support element. Compared to previous solutions, there are no changes of the lever ratios and, therefore, there are no changes in the contact pressure forces of the brush roll against the work roll when the roll configuration is changed. Moreover, a construction is achieved which requires very little space and can be integrated in existing structural elements of the roll stand. When the work rolls are exchanged, no complicated assembly or disassembly measures or additional adjustments are required. The exchange of work rolls, i.e., the exchange of work rolls together with the chocks of the work rolls, can be carried out as quickly as it is known to be possible in work rolls without brush rolls.

In accordance with a preferred further development of the invention, the actuating element is a hydraulically double-acting piston-cylinder unit whose piston shaft rests against the pivoting lever. Compared to, for example, a pneumatic or mechanical actuating element, the hydraulic actuation provides the advantage that a very accurate adjustment and controllable readjustment of the brush roll can be carried out, depending on the type of material used. Also, in order to achieve an optimum cleaning effect, the pressure exerted by the brush roll can be adjusted more finely.

In accordance with a further development of the adjusting device, the support element is composed of a support rod resting against the pivoting lever and of a support cylinder, wherein the support rod is insertable in the support cylinder against the force of a spring arrangement and the support cylinder is pivotally mounted on the chock of the work roll. As a result, the support forces which must be absorbed by the pivoting lever can be introduced into the chock without causing bending forces.

In accordance with a preferred feature, the pivoting lever of the support is connected to the support rod by means of a rotary joint. As a result of this feature, it is possible in an advantageous manner to preset a fixed adjusting position of the brush roll, i.e., a constant distance between brush roll and work roll. For this purpose, the support rod in the support cylinder may include a longitudinally adjustable stop element or travel limiting element.

In order to take into consideration the narrow space available for mounting elements in a roll stand, it is proposed in accordance with another development of the invention that the actuating element for the pivoting lever is arranged in the balancing block for the work rolls, wherein the balancing block is provided with at least one hydraulic cylinder.

If a roll stand is provided with only roll bending or with roll bending and CVC rolls, it is proposed that the actuating element for the pivoting lever is arranged in the bending block for the work rolls, wherein the bending block is fixed or displaceable and provided with at least one hydraulic cylinder.

To make it possible that the actuating element can act without addition of measures directly on the pivoting lever of the brush roll support, another development of the present invention provides that the piston cylinder unit of the actuating element is arranged on the respective inner sides (facing the rolled strip) of the balancing block or bending block.

In order to improve the compact construction of the brush roll adjusting system, another feature of the present invention provides that a shaft piece with unilateral connecting flange and oppositely located clamp coupling is rotatably mounted in the brush roll support. The flange of the shaft piece is connected to the brush roll and to a universal joint shaft which is movable in rotary and translatory movements.

The compact construction of the device is completed by another advantageous feature which provides that the universal joint shaft is connected to a drive unit composed of hydraulically operating motor and hydraulically acting oscillating cylinder, wherein the drive unit is arranged on the chock of the work roll. This excludes any relative movement between the support and the drive of the brush roll.

The use of a hydraulically operating drive motor with a hydraulically acting oscillating cylinder according to the present invention makes possible another preferred structural feature according to which a portion of the shaft piece of the clamp coupling and/or the universal joint shaft extends through the chock of the work roll to the drive unit which is flanged to the outer surface of the chock.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
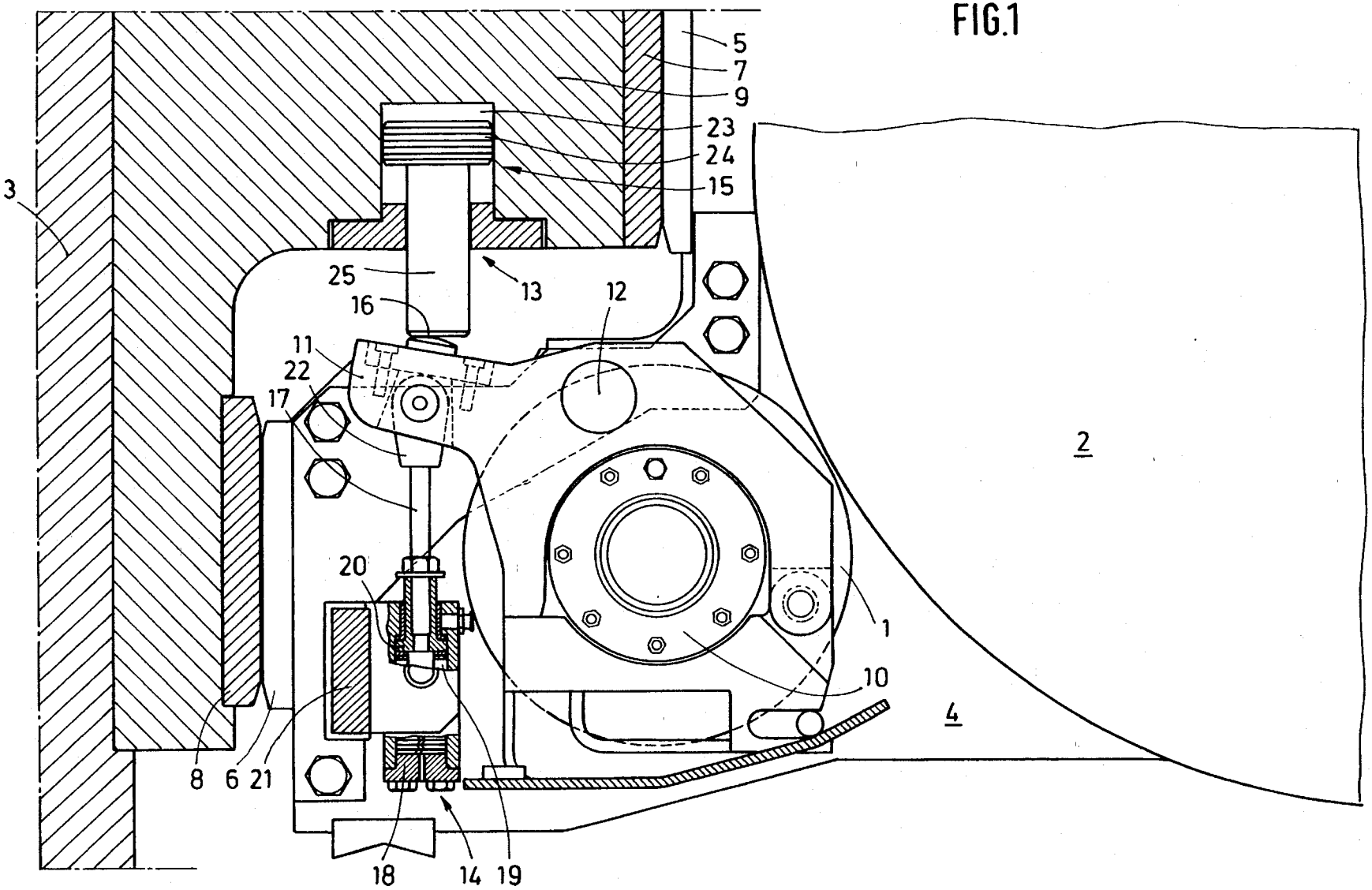
FIG. 1 is a schematic side view, partially in section, of the brush adjusting device according to the present invention with hydraulically operating actuating element and spring-loaded support element.

FIG. 1 of the drawing is a side view, partially in section, of the device according to the present invention for adjusting the brush roll 1 relative to the work roll 2, for example, of a roll stand for hot-rolling of aluminum. Such a roll stand includes housings 3 in which the upper and lower work rolls 2 are arranged. The work rolls 2 may be supported by upper and lower back-up rolls. All rolls are aligned in a vertical plane in the upright roll stand. The respective rolls are supported in bearings which are received by chocks. The chocks and the rolls can be inserted into the stand and removed from the stand through windows in the stand and are anchored in the stand. These principal structural features of a roll stand are known to those skilled in the art and, therefore, are not illustrated in detail. Thus, FIG. 1 of the drawing only shows a portion of the roll stand which includes the adjusting device for the brush roll.

As shown in FIG. 1, the lower work roll 2 is supported in the chock 4. On its side facing the balancing block 9, the chock has sliding plates 5, 6 which, in turn, rest against sliding plates 7, 8 of the balancing block 9. The chock 4 is adjusted by means of a balancing cylinder, not shown in detail, which is arranged in the balancing block 9.

The device for adjusting the brush roll 1 relative to the work roll 2 includes a support 10 which is rotatably mounted in the brush roll 1 and is displaceable by translatory movements parallel to the work roll. In order to achieve a good cleaning effect, the brush roll 1 and the work roll 2 rotate in opposite directions which results in the relative movement between the surface of the work roll and the bristles of the brush roll to obtain the cleaning effect. The support 10 of the brush roll 1 includes a pivoting lever 11.

The support 10 is pivotally mounted in a pivot bearing 12. The pivoting lever 11 is located between an actuating element 13 and a restoring support element 14. The support element 14 is arranged on the chock 4 of the work roll. The actuating element is arranged either in the balancing block 9 or, if bending of the rolls is provided, in the bending block which is provided in this latter case. The actuating element 13 includes a hydraulically double-acting piston-cylinder unit 15 whose piston rod 25 rests against the pivoting lever 11. The support element 14 is composed of a support rod 17 connected to the pivoting lever 11 and of a support cylinder 18, wherein the support rod 17 can be inserted into the support cylinder against the force of a spring arrangement 19. The support rod includes an adjustable limiting element 20. The support cylinder 18 is pivotally mounted on the work roll chock 4 in a bearing block 21. The connection of support rod 17 and pivoting lever 11 is effected by a fork-shaped wall member 22 which is secured to the pivoting lever 11 by means of a bolt.

FIG. 1 of the drawing shows the adjusting position of the brush roll in which the brush roll 1 and the work roll 2 are preadjusted to a minimum distance between the rolls. Contact of the surfaces of the two rolls can be effected by actuating the piston-cylinder unit 15. For this purpose, a hydraulic pressure medium is forced into the cylinder space 23 of the actuating element, so that the piston 24 and the piston shaft 25 are lowered downwardly in the direction toward the chock 4. Consequently, the head of the piston rod 25 presses the pivoting lever 11 of the support 10 downwardly at the contact surface 16 against the force of the spring of the support element 14, so that the brush roll is moved toward the work roll until the brush roll rests against the work roll. When the pressure acting on the piston-cylinder unit 15 is hydraulically released, the piston shaft 25 of this unit is moved upwardly and the spring-loaded support rod 17 moves upwardly to the same extent and acts on the pivoting lever 11 in such a way that the support of the brush roll and, thus, the brush roll itself, is pivoted downwardly and away from the work roll about the pivot bearing 12 until a predetermined distance between the two rolls is reached. This distance is adjustably preset by the appropriate adjustment of the limiting element 20 at the support rod 17.

Figure 2:
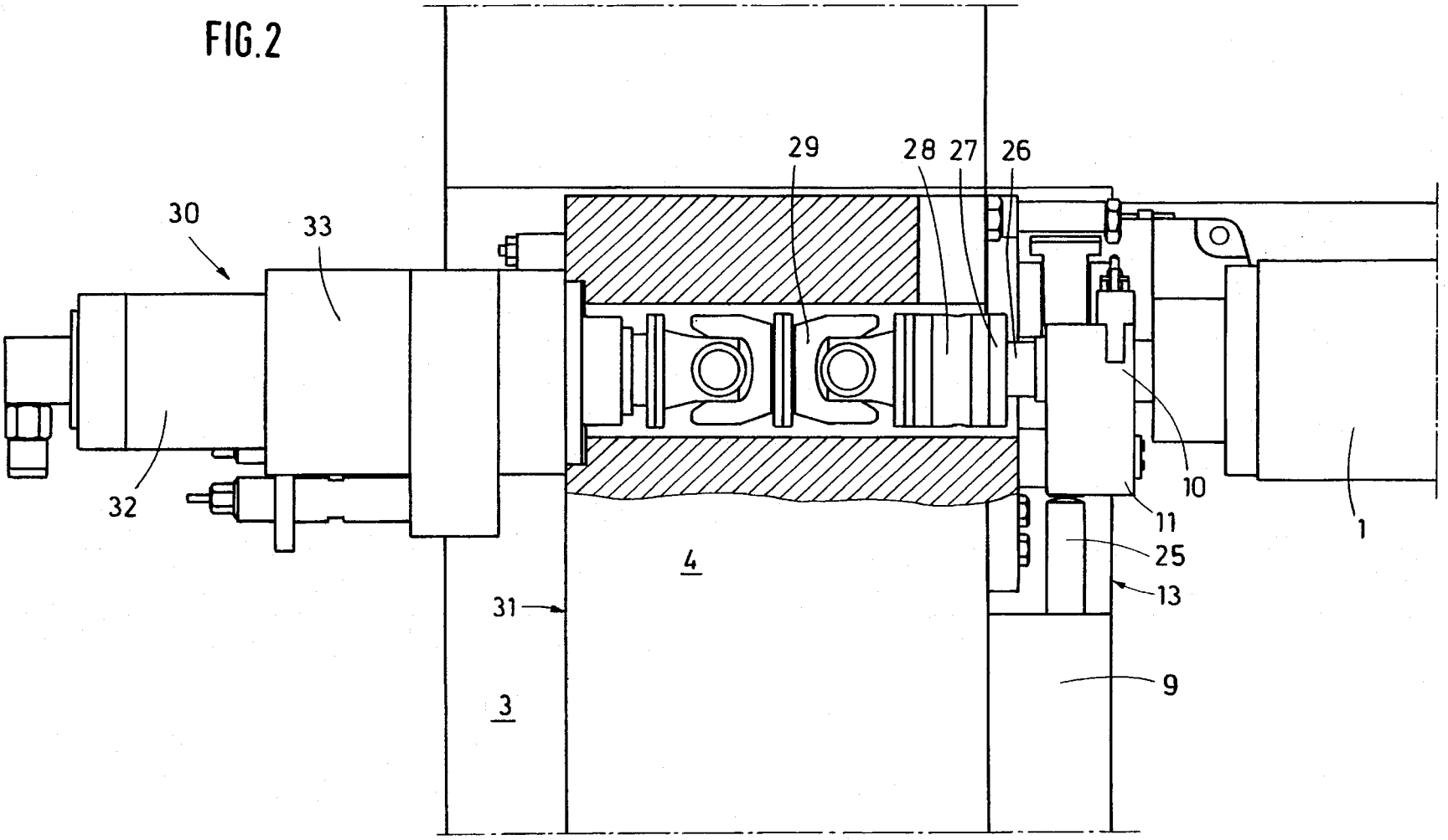
FIG. 2 is an elevational view, partially in section, of the arrangement of the drive system for the brush roll.

FIG. 2 of the drawing is a partial sectional view of the work roll 2, the brush roll 1, the housing 3 and the actuating element 13 constructed as piston-cylinder unit 15 in the balancing block 9. FIG. 2 further shows the support 10 for the brush roll 1 and the pivoting lever 11 which is in operational engagement with the piston shaft 25 of the piston-cylinder unit 15. A shaft piece 26 with a unilateral connecting flange 27 and clamp coupling 28 are rotatably mounted in the brush roll support 10, wherein the connecting flange 27 is connected to the brush roll and the clamp coupling 28 is connected to a universal joint shaft 29 which is movable to carry out rotary as well as translatory movements. A portion of the shaft piece 26, the clamp coupling 28 and the universal joint shaft 29 extend through the work roll chock 4 and are connected to a drive unit 30 which is flanged to the outer surface 31 of the chock. The drive unit 30 is composed of a hydraulically operating motor, i.e., the hydraulic motor 32, and a hydraulically acting oscillating cylinder 33. The brush roll 1 resting on the surface of the work roll 2 is rotated by the drive unit and is also displaced by the drive unit in an oscillating manner in axial direction of the work roll.

The embodiment of the present invention illustrated in FIGS. 1 and 2 of the drawing clearly shows that the above-described object has been met in an ideal manner by providing a compact adjusting device for the brush roll which is exactly adjustable, does not allow relative movement between the support, the actuating cylinder and the support element, and makes additional assembly operations unnecessary when the work rolls together with the chocks are to be exchanged. A reverse arrangement of the elements of the adjusting device is also within the scope of the present invention.

The invention is not limited by the embodiments described above which are presented as examples only but can be modified in various ways within the scope of protection defined by the appended patent claims.

We claim:

1. A device for adjusting a brush roll relative to a work roll in a roll stand for hot-rolling of aluminum, wherein the brush roll is rotatable in a direction opposite the direction of rotation of the work roll, and wherein the roll stand comprises means for displacing in a translatory movement the brush roll parallel to the work roll, the roll stand including a chock and a balancing block for the work roll, the adjusting device comprising support means for the roll brush mounted on the chock, each support means comprising a pivot bearing and a pivoting lever for pivoting the roll brush about the pivot bearing relative to the work roll, a controllable actuating element mounted in the balancing block and a restoring support element mounted on the chock, wherein the pivoting lever is mounted between the controllable actuating element and the restoring support element.

2. The adjusting device according to claim 1, wherein the actuating element comprises a hydraulically double-acting piston-cylinder unit, the piston-cylinder unit comprising a piston shaft, wherein the piston shaft rests against the pivoting lever.

3. The adjusting device according to claim 1, wherein the support element comprises a support rod resting against the pivoting lever and a support cylinder including a spring arrangement, wherein the support rod is insertable in the support cylinder against the spring arrangement, and wherein the support cylinder is pivotally mounted on the chock.

4. The adjusting device according to claim 1, wherein the actuating element for the pivoting lever mounted in the balancing block for the work roll comprises at least one hydraulic cylinder.

5. The adjusting device according to claim 2, wherein the balancing block has inner sides facing material being rolled, the piston-cylinder unit of the actuating element being mounted on the inner sides of the balancing block.

6. The adjusting device according to claim 3, comprising a rotary joint for connecting the pivoting lever of the support means to the support rod.

7. The adjusting device according to claim 1, wherein the pivoting lever comprises contact surfaces for contacting the actuating element and the support element, wherein at least one of the contact surfaces is spherically shaped.

8. The adjusting device according to claim 1, wherein the support means for the brush roll comprises a shaft piece with a unilaterally mounted connecting flange and an oppositely mounted clamp coupling, the shaft piece being rotatably mounted in the support means, wherein the flange is connected to the brush roll and the clamp coupling is connected to a universal joint shaft which is movable in rotary as well as translatory movements.

9. The adjusting device according to claim 8, wherein the universal joint shaft is connected to a drive unit, the drive unit comprising a hydraulically operating motor and a hydraulically acting oscillating cylinder, wherein the drive unit is mounted on the chock.

10. The adjusting device according to claim 9, wherein at least one of a portion of the shaft piece and the universal joint shaft extends through the chock to an outer surface of the drive unit which is flanged to the chock.

11. A device for adjusting a brush roll relative to a work roll in a roll stand for hot-rolling of aluminum, wherein the brush roll is rotatable in a direction opposite the direction of rotation of the work roll, and wherein the roll stand comprises means for displacing in a translatory movement the brush roll parallel to the work roll, the roll stand including a chock and a bending block for the work roll, the adjusting device comprising support means for the roll brush mounted on the chock, each support means comprising a pivot bearing and a pivoting lever for pivoting the roll brush relative to the work roll, a controllable actuating element mounted in the bending block and a restoring support element mounted on the chock, wherein the pivoting lever is mounted between the controllable actuating element and the restoring support element.

12. The adjusting device according to claim 11, wherein the actuating element comprises a hydraulically double-acting piston-cylinder unit, the piston-cylinder unit comprising a piston shaft, wherein the piston shaft rests against the pivoting lever.

13. The adjusting device according to claim 11, wherein the support element comprises a support rod resting against the pivoting lever and a support cylinder including a spring arrangement, wherein the support rod is insertable in the support cylinder against the spring arrangement, and wherein the support cylinder is pivotally mounted on the chock.

14. The adjusting device according to claim 11, wherein the actuating element for the pivoting lever mounted in the bending block for the work roll comprises at least one hydraulic cylinder.

15. The adjusting device according to claim 11, wherein the bending block has inner sides facing material being rolled, the piston-cylinder unit of the actuating element being mounted on the inner sides of the bending block, wherein the bending block is one of stationary and displaceable.

16. The adjusting device according to claim 11, comprising a rotary joint for connecting the pivoting lever of the support means to the support rod.

17. The adjusting device according to claim 11, wherein the pivoting lever comprises contact surfaces for contacting the actuating element and the support element, wherein at least one of the contact surfaces is spherically shaped.

18. The adjusting device according to claim 11, wherein the support means for the brush roll comprises a shaft piece with a unilaterally mounted connecting flange and an oppositely mounted clamp coupling, the shaft piece being rotatably mounted in the support means, wherein the flange is connected to the brush roll and the clamp coupling is connected to a universal joint shaft which is movable in rotary as well as translatory movements.

19. The adjusting device according to claim 18, wherein the universal joint shaft is connected to a drive unit, the drive unit comprising a hydraulically operating motor and a hydraulically acting oscillating cylinder, wherein the drive unit is mounted on the chock.

20. The adjusting device according to claim 19, wherein at least one of a portion of the shaft piece and the universal joint shaft extends through the chock to an outer surface of the drive unit which is flanged to the chock.

* * * * *